US005181365A

United States Patent [19]

Garvey et al.

[11] Patent Number: 5,181,365

[45] Date of Patent: Jan. 26, 1993

[54] METHOD AND APPARATUS FOR FORMING INDIVIDUAL POUCHES FROM A CONTINUOUS WEB AND PACKAGING A PRODUCT IN THE INDIVIDUAL POUCHES

[75] Inventors: Joseph F. Garvey, Oakdale; Aaron A. Minion, Minneapolis; Warren T. Smith, Minnetrista, all of Minn.

[73] Assignee: Minnesota Mining and Manufacturing Company, St. Paul, Minn.

[21] Appl. No.: 804,357

[22] Filed: Dec. 9, 1991

[51] Int. Cl.[5] ..... B65B 9/08

[52] U.S. Cl. ..... 53/455; 53/410; 53/459; 53/562; 53/568; 493/196; 493/248

[58] Field of Search ..... 53/455, 456, 459, 562, 53/410, 412; 493/248, 254, 212, 930, 193, 194, 195, 196, 189

[56] References Cited

U.S. PATENT DOCUMENTS

| | | | |
|---|---|---|---|
| 3,394,870 | 7/1968 | Curtis | 229/56 |
| 3,765,309 | 10/1973 | Joice et al. | 493/196 X |
| 3,799,914 | 3/1974 | Schmit et al. | 426/85 |
| 3,829,007 | 8/1974 | Ellison | 229/55 |
| 3,872,621 | 3/1975 | Greenbaum | 47/1.2 |
| 4,216,639 | 8/1980 | Gautier | 53/455 X |
| 4,358,466 | 11/1982 | Stevenson | 493/189 X |
| 4,361,235 | 11/1982 | Gautier | 206/527 |
| 4,428,477 | 1/1984 | Cristofolo | 206/210 |
| 4,453,370 | 6/1984 | Titchenal | 53/455 |
| 4,454,979 | 6/1984 | Ikeda et al. | 229/52 |
| 4,534,752 | 8/1985 | Ferrell et al. | 493/248 X |
| 4,601,157 | 7/1986 | Adelman | 53/450 |
| 4,631,901 | 12/1986 | Chung et al. | 53/455 |
| 4,693,056 | 9/1987 | Raszewski | 53/450 |
| 4,774,797 | 10/1988 | Colamussi et al. | 53/459 |
| 4,795,271 | 1/1989 | Lane, Jr. et al. | 383/104 |
| 4,810,109 | 3/1989 | Castel | 383/105 |
| 4,810,844 | 3/1989 | Anderson | 219/10.55 |
| 4,837,849 | 6/1989 | Erickson et al. | 383/104 |
| 4,864,802 | 9/1989 | D'Angelo | 53/450 |
| 4,890,439 | 1/1990 | Smart et al. | 53/410 |
| 4,904,093 | 2/1990 | Woods et al. | 383/120 |
| 4,937,410 | 6/1990 | Anderson | 219/10.55 |
| 4,950,859 | 8/1990 | Anderson | 219/10.55 |
| 5,030,190 | 7/1991 | Woods et al. | 493/254 X |

*Primary Examiner*—James F. Coan

*Attorney, Agent, or Firm*—Gary L. Griswold; Walter N. Kirn; Mark W. Binder

[57] ABSTRACT

The present invention includes a process and apparatus for producing highly specialized individual product pouches with high efficiency and simplicity at production speeds that are easily obtainable with present day forming machines, particularly, horizontal-type form-fill-seal machines. The subject process and apparatus advantageously form pouches from a continuous supply of flexible web material by folding the flexible web material into two side walls and a bottom gusset and performing one or more forming operations on only one of the gusset portion and lower side wall combinations at one time. Such forming operations may include any operation which physically or perspectively alters the appearance or nature of the pouches. After at least one such forming operation is conducted, a plurality of side seals are provided to define at least one specialized pouch. Preferably, during such forming operations, a separation element is inserted within the bottom gusset to effectively isolate one of the gusset portion and lower side wall combinations from the other.

44 Claims, 4 Drawing Sheets

METHOD AND APPARATUS FOR FORMING INDIVIDUAL POUCHES FROM A CONTINUOUS WEB AND PACKAGING A PRODUCT IN THE INDIVIDUAL POUCHES

TECHNICAL FIELD

The present invention is related to the formation of individual packages, such as pouches, and the packaging of product within the individually formed pouches. More particularly, specialized pouches are made in accordance with the present invention that are designed in relationship to and in order to accommodate the specific product to be contained therein.

BACKGROUND OF THE INVENTION

With the advent over recent years of specialized packaging for products, where the packaging is designed to accommodate the particular product, the dispensing of such product, or the cooking of such product if the product is a foodstuff, it has become increasingly difficult to manufacture such specialized packages. Moreover, to include product specific features to the packaging, so as to enhance cooking or product dispensing, from a continuous web of material is even harder.

It is, of course, a manufacturing concern to produce individual product packages in a most economical manner. The conversion of a continuous web of material into such individual packages without the need for additional components is highly desirable toward that goal. However, it is also desirable to provide such individual packages with specialized features related to the specific product for dispensing or cooking which are not only effective, but which users of such packages also find convenient.

Many forming processes and apparatuses are known for converting a web of flexible material into individual packages or pouches, which may be made in line with filling and final sealing stations. Such typical machines are generally classified as either horizontal type or vertical type forming machines. Moreover, such machines may employ means for continuously moving the web material through conversion stations of the machine, or may intermittently move the web material while controlling the conversion operations to occur during rest periods between movements.

An example of a horizontal forming machine with intermittent movement that is used to manufacture relatively complex individual food containers from a continuous web of material is described in U.S. Pat. No. 4,361,235 to Gautier. Such process initially includes folding the continuous web of material into two side walls with a bottom gusset extending therebetween in a generally W shape. Thereafter, various heat sealing and cutting operations are sequentially performed between intermittent movements of the web to produce specialized two compartment packages. The conversion steps, however, are performed from both sides of the folded web so that such operations must be equally performed on both of the side walls and the bottom gusset.

Other individual specialized packages which are formed from a continuous web of flexible material are described in U.S. Pat. Nos. 4,774,797 to Colamussi et al, 4,453,370 to Titchenal, and 4,631,901 to Chung et al. The bags of Colamussi et al and Titchenal include the formation of a bottom gusset which extends between side walls during the individual bag manufacture. Such gussets are utilized to provide an expanded or square end of the bags when they are filled, as conventionally known. Chung et al discloses a complex heat sealing sequence for making individual sealed packets containing pre-determined amounts of flowable product. Like Gautier above, converting or forming operations are equally conducted on both sides of the bags of Colamussi et al, Titchenal and Chung et al.

Yet another manufacturing technique for making individual bags from a continuous web of flexible material is disclosed in U.S. Pat. No. 3,829,007 to Ellison. The bags of Ellison require two folding operations providing a bottom gusset with ends thereof doubled back against the side walls followed by a heat sealing step at the bottom edges to render the bag free standing. Once again, each forming step is applied to both sides of each bag.

Clearly, as highly specialized packages are designed to incorporate additional features which are more effective and more convenient to the end user, it is desirable to not only manufacture such packages efficiently, that is from a continuous web of material, but also to do so at production speeds that are standard in the industry today and with as simple machine as possible. However, the more specialized the features that are to be incorporated into such package designs, the greater is the complexity of the forming machines, which generally results in slower production.

One important feature that is desirable in many specialized packages is an easy open feature which allows access to the contents of the package. Another is a dispensing spout or the like which makes it easy to controllably discharge the products from within the packages. The provision of tear strips, lines of weakening, and the like, per se, are well known. However, incorporating an easy opening feature within a specialized package, such as a bag or pouch, and in accordance with the manufacturing goals set forth above, is much more difficult. Such is compounded when a bag or pouch is further specifically designed to accommodate a particular product or to enhance cooking of the product if it is a foodstuff.

Ikeda et al, U.S. Pat. No. 4,454,979 discloses a laminated bag formed with a spout with means to facilitate opening of the bag. The bag is designed for containing a fluid therein and to make the bag free standing.

Another type of specialized packaging includes bags which are specifically designed to enhance microwave cooking. One example is described in U.S. Pat. No. 4,890,439 to Smart et al, wherein a lay-flat bag is provided including a top center access. Other microwave packages are described in U.S. Pat. Nos. 4,810,844, 4,937,410 and 4,950,859 to Anderson, which comprise flat bottom portions with substantially central upwardly extending walls which provide access to the bags interiors. The '410 bag provides access through the upright side seam of the walls, while the others provide access through the top edge. Such access simply permits the filling of the bags with product and the subsequent removal of the product. None of these, however, facilitate any kind of controlled dispensing of product from the bags. They only provide simple access to the contents once cooked.

Yet another microwave type bag is disclosed in U.S. Pat. No. 4,358,466 to Stevenson and U.S. Pat. Nos. 4,904,093 and 5,030,190 to Woods et al. In each of these cases, the bag is formed of two wing-shaped pouches on either side of an upright spout. The spout is an access opening including a reclosable zipper to provide for the simple filling or removing of product to or from the bag in a similar manner as that discussed above in the Anderson references. The spout is not designed to facilitate any kind of controlled dispensing. The suggested process of making Stevenson's bag includes gusseting the bottom of the bag and heat sealing the appropriate side edges, wherein the open non-gussetted section thereof forms the central neck portion which provides the spout.

SUMMARY OF THE PRESENT INVENTION

The present invention provides a process and apparatus capable of producing highly specialized individual product pouches with high efficiency and simplicity at production speeds that are easily obtainable with present day forming machines. The pouches are formed from a continuous web or webs of flexible material. The material can be chosen according to the product to be contained therein and how the product is to be stored, dispensed, or cooked if the product is a foodstuff. Moreover, the process and apparatus of the present invention is versatile such that various forming operations can be conducted alone or in combination with one another on only certain chosen portions of each pouch without changing other portions. Thus, such forming operations can be more selectively applied to the pouches to result in highly specialized packages.

As a result of this increased versatility, individual product packaging can be more easily tailored to the specific product, thereby relating the package to the product with more advantageous features specific to the type of product. Moreover, such versatility is attained by the present invention at production speeds that are expected with present day forming machines that are still relatively simple overall. The process and apparatus of the present invention is particularly applicable to a horizontal forming process and machine in that product is to be filled within the formed pouches from a direction generally perpendicular to the direction of travel of the continuous web of material and the formation of individual pouches.

Such advantages are achieved by a process and apparatus in accordance with the present invention for forming at least one pouch from a continuous supply of flexible web material. It is understood that the flexible web material can be supplied as a single web which is converted into pouches, or may include multiple webs which are continuously supplied and joined together at the same overall production rate. In either case, the web or multiple webs are converted into the subject specialized pouches by the same overall conversion steps. The process and apparatus of the present invention include the steps of and means for continuously supplying the flexible web material, folding the flexible web material to provide two side walls and a bottom gusset and performing a forming operation on only one of the gusset portion and lower side wall portion combinations. Additionally, a plurality of transverse seals are provided dividing the folded web into at least one product pouch.

In order to perform a forming operation on only one gusset portion and lower side wall combination, such gusset portion and lower side wall combinations are preferably operatively separated from one another just prior to and during the forming operation. Such separation may not be necessary depending on the type of forming operation or the conditions under which such forming operation is controlled. Separation may be done by inserting a separation element within the gusset or may include the insertion of a plowing element within the gusset which actually urges one of or both of the gusset portion and lower side wall combinations away from one another. The forming operation may include any forming operation that physically or perceptively changes the physical appearance or nature of one gusset portion and lower side wall combination from the other. Examples of such forming operations are partially connecting or sealing one gusset portion to a lower side wall, cutting away some of the material of the combination gusset and lower side wall, both sealing and cutting, or any other forming operation in accordance with the above.

More specifically in accordance with the present invention, the subject process and apparatus forms a lay-flat type pouch containing a product which is specifically advantageous for heating of the product in a microwave oven, and which provides a spout through which the product, such as a foodstuff can be easily and controllably dispensed. To manufacture such specialized pouches, according to the aforementioned process and apparatus, one of the gusset portion and lower side wall combinations is first partially sealed together, preferably by heat sealing, to form a spout from such gusset portion and lower side wall combination, and secondly trimming excess material of the combination that has been sealed together in a way so as to also define a spout with an easy open feature. Preferably also, each of the forming operations, namely heat sealing and cutting, are performed while the gusset portion and lower side wall combinations are separated from one another. In the first instance, a separating element inserted within the gusset is preferred, and during the cutting, a separation plow is preferably inserted within the gusset which urges both gusset portion and lower side wall combinations away from one another.

BRIEF DESCRIPTION OF THE DRAWINGS

The present invention will be further described below with reference to the accompanying drawings, wherein a preferred process and apparatus in accordance with the present invention is illustrated and described, in which.

DETAILED DESCRIPTION OF THE PREFERRED EMBODIMENT

Figures 1, 2:
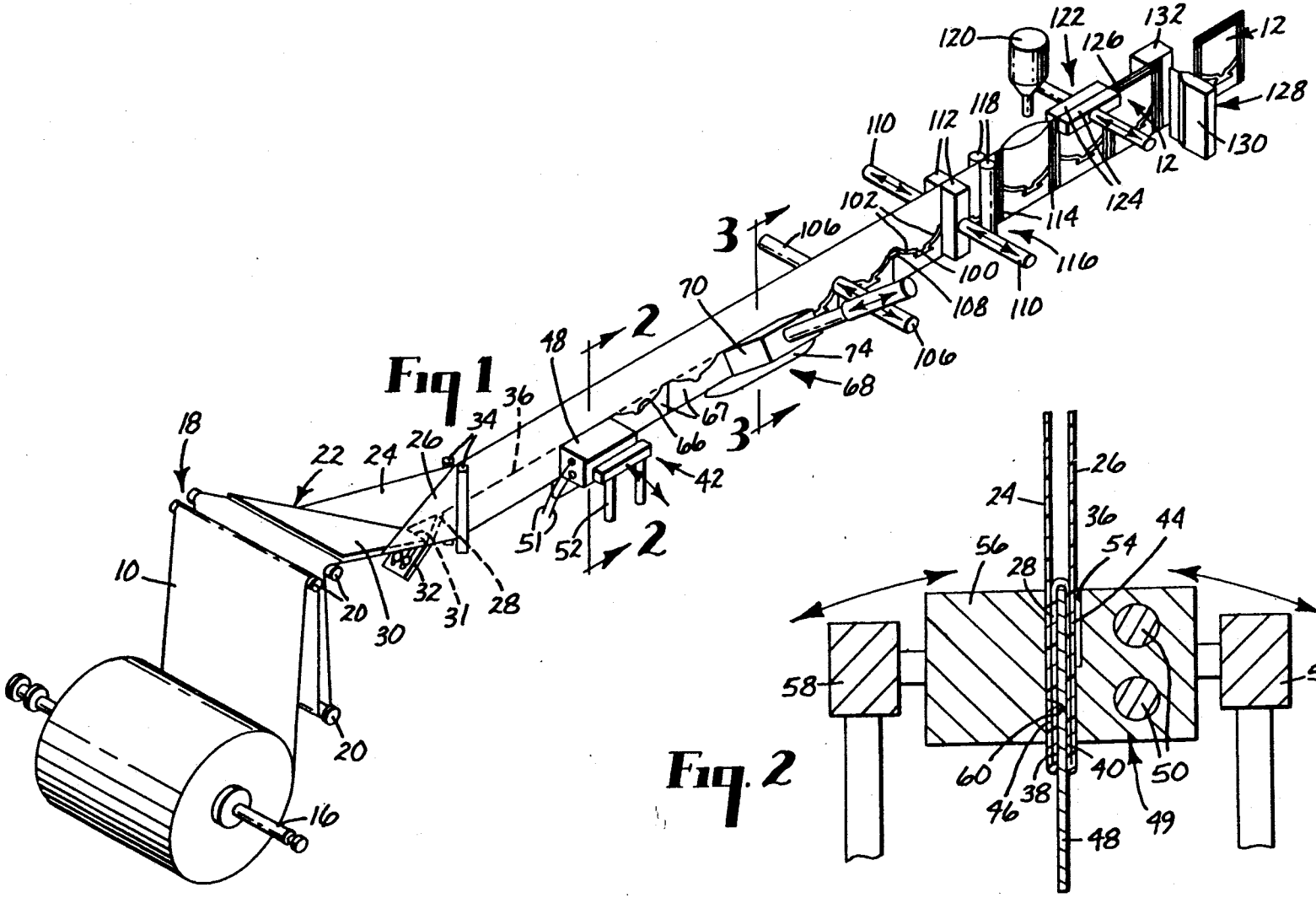
FIG. 1 is a schematic view in perspective of a forming, filling and sealing process and apparatus in accordance with the present invention.
FIG. 2 is a transverse cross-section taken along line 2—2 in FIG. 1 illustrating a first heat-seal forming operation with a separating element extending within a longitudinal gusset of the flexible web material.

Referring now to the Figures, wherein like numerals are used to designate like components throughout each of the several Figures, and in particular to FIG. 1, a process and apparatus in accordance with the present invention are schematically illustrated for converting a continuous supply of flexible web material 10 into individual product pouches 12. It is preferable that the flexible web material 10 can be supplied as a single web; however it is understood that it may include multiple webs which are brought together before or during the folding and forming operations described below. If done by multiple webs, the widths of each web would depend on that portion of the finished pouch to which they are to apply. Such multiple webs can be continuously secured together by conventional means, including heat sealing, adhesives, or the like.

The continuous supply of flexible web material 10 is preferably supplied as a roll 14 which can be conventionally supported on a spindle 16. The spindle 16 may be connected to a web feeding drive assembly in a conventional manner, if desired, in which case the spindle 16 would be rotationally secured with the roll 14. Otherwise, the roll 14 may be freely rotatable on the spindle 16 so that as the web material 10 is demanded by the apparatus, as explained below, it is simply unwound from the roll 14. Moreover, in either case, it is preferable to provide a conventional roll brake mechanism (not shown) or a friction drag type brake which are commonly known to retard rotation of the roll 14 during rest periods between movements when the apparatus is an intermittent motion-type machine. In one such case, a conventional stop-switch assembly (not shown) could be provided to activate the roll brake during such rest periods. When the roll 14 is driven, the drive means (not shown) and the roll brake must be appropriately timed with respect to one another as well as the conversion steps described below.

Initially, the flexible web material 10 is threaded over a tensioning assembly 18 comprising a plurality of tension rollers 20, at least one of which is conventionally supported in a manner to be moveable and which is adjustable or under the action of a biasing tensioning means (not shown). Such adjustment or tensioning can be mechanized, electrical, pneumatic, or the like, as well known. After leaving the last tension roller 20, the flexible web material 10 is passed along a plow assembly 22 which folds the flexible web material 10 into a generally W-shape comprising side walls 24 and 26 connected at bottom edges thereof by a bottom gusset 28. As noted above, such folding may include compiling multiple webs into one web. The plow assembly 22 specifically comprises a triangular plate 30 having a nose portion 31 that is cut back and which in conjunction with a gusset blade 32 forms the bottom gusset 28. The flexible web material 10 rides along the lower surface of plate 30, and passes through a nip formed between the edge of nose portion 31 and the gusset blade 32. The gusset blade 32 includes a pointed end that extends for a predetermined length in a direction transverse to or across from the direction of travel of the flexible web material 10 from the nose portion 31 at an angle to the plate 30 to define the bottom gusset 28. The gusset blade 32 is preferably adjustably connected to the frame (not shown) of the apparatus so that the depth of the bottom gusset 28 can be adjustably defined. In accordance with the preferred process and apparatus of the present invention, the depth of the gusset 28 is preferably about ½ of the transverse dimension of the side walls 24 and 26, which is considered relatively deep, for reasons explained below. After leaving the plow assembly 22, the folded flexible web material 10 preferably passes through creaser bars 34 so as to cleanly define the fold lines between side walls 24 and 26 and bottom gusset 28 and, as best shown in FIG. 2, to provide fold line 36 which divides the bottom gusset 28 into gusset portions 38 and 40.

Any number of conversion steps can be applied after this point. By conversion, it is meant any forming operation that physically or perceptively changes the physical appearance or nature of any portion of the folded flexible web material 10. Examples of such forming operations include connecting or sealing portions of the flexible web material 10 together, cutting any portion thereof, before, during or after sealing, or the like in accordance with the above.

A first conversion step takes place after the folded flexible web material 10 leaves the creaser bars 34 at a first forming means 42. In accordance with making the pouches 12 of the present invention, the first forming means is a sealing means, preferably a heat sealing means. The first forming means 42, as seen in FIG. 2, is used to heat seal gusset portion 40 to a lower side wall portion 44 of the side wall 26. The gusset portion 40 and the lower side wall portion 44 together comprise one gusset portion and lower side wall portion combination. Yet another such gusset portion and lower side wall portion combination is also formed comprised of the gusset portion 38 and lower side wall portion 46. In accordance with an advantageous feature of the process and apparatus of the present invention, only one of the gusset portion and lower side wall portion combinations is modified by the first forming means 42. That is, the physical appearance or nature of such combination comprising gusset portion 40 and lower side wall portion 44 is changed by heat sealing a part of gusset portion 40 to a part of lower side wall portion 44.

In order to perform the first forming operation on only one of the gusset portion and lower side wall portion combinations, the gusset portion and lower side wall portion combinations are preferably operatively separated from one another such that the forming operation is conducted on only the selected gusset portion and lower side wall portion combination. One way of operatively separating the gusset portion and lower side wall portion combinations is to insert a separation element 48, as seen in FIG. 2, within gusset 28, preferably substantially to fold line 36.

It is understood that the provision of such a separation element is optional depending on the type of forming operation conducted and the manner under which any such forming operation is controlled. For example, in a heat sealing operation, control of the sealing parameters such as temperature and dwell may accomplish the requisite heat sealing without runaway heating which affect the other gusset portion and lower side wall combination. Moreover, the need for such a separation element depends on the characteristics of the material, including the exterior surface thereof and the heat transfer ability of any of any number of layers thereof.

The first forming means 42 comprises a reciprocating profiled heat sealing bar 49 which is operationally controlled to heat seal a part of gusset portion 40 to a part of lower side wall portion 44. The reciprocating profiled heat sealing bar 49 includes conventional heating elements 50 which are connected by electrical wires 51 to an electrical source (not shown) in a conventional manner. The heating elements 50 are electrically heated to thus raise the temperature of the profiled heating bar 49 above the temperature necessary to perform a heat sealing operation depending on the melt temperature of the flexible web material 10 that is chosen. The reciprocating profiled heat sealing bar 48 is shown fixed with a drive linkage 52 that reciprocally moves the profiled heat sealing bar 49. The drive linkage 52 is conventionally driven and timed such that a profiled face 54 of the profiled heat sealing bar 49 contacts the outer surface of lower side wall portion 44 while the exterior surface of gusset portion 40 contacts separation element 48 during a rest period between intermittent movements of the subject apparatus. Such means for driving and timing the movement of the drive linkage 52 is well known and does not comprise a specific part of the subject invention. Typically, in an intermittent motion type horizontal machine, a center drive shaft (not shown) is provided from which the elements of the forming stations are timed and driven.

Although the use of the separation element 48 effectively isolates the heat sealing forming process of the first forming means 42 to the lower side wall portion 44 and the gusset portion 40 combination, it is also preferable to provide a reciprocating support block 56 which moves in coordination with the profiled heat sealing bar 49. The reciprocating support block 56 is similarly connected to a drive linkage 58 which is also conventionally driven and timed in accordance with the drive assembly of the subject apparatus. More specifically, a front surface 60 of the reciprocating support block 56 contacts the exterior surface of the lower side wall portion 46 at substantially the same time that the profiled face 54 of the reciprocating profiled heat sealing bar 49 contacts the lower side wall portion 44. As shown, such contact occurs while separation element 48 lies within gusset 28.

Figure 4:
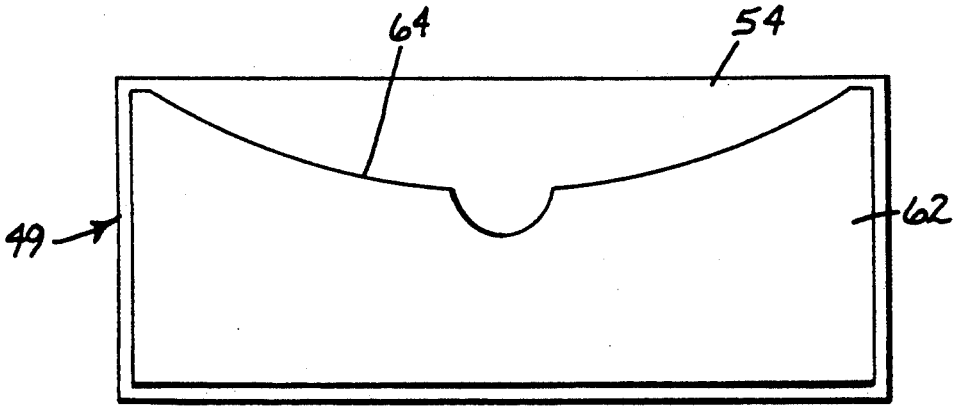
FIG. 4 is a front view of the heat sealing element shown in FIG. 2 which forms a spout in one leg of the flexible web material by partially heat sealing a gusset portion to a side panel portion for each individual pouch made.

The profiled face 54 of the reciprocating heat sealing bar 49, as seen in FIG. 4, comprises a raised surface 62 which defines the shape of the heat seal formed from the one gusset portion and lower side wall portion combination, namely gusset portion 40 and lower side wall portion 44. The raised surface 62, in accordance with the forming of pouches 12 by the present invention, defines a spout-shape by a contoured edge 64 thereof. Thus, as seen in FIG. 1, the contoured edge 64 defines a spout 66 for each pouch 12 subsequent to the first forming means 42. As the continuous flexible web material 10 is advanced, by means described below, such spouts 66 are sequentially formed by partial heat sealed portions 67 of the gusset portion 40 and lower side wall portion 44 combination in the shape of raised surface 62.

Referring again to FIG. 1, a second conversion operation takes place next comprising a second forming means 68. The second forming means 68 also performs a forming operation on only one of the gusset portion and lower side wall portion combinations. In accordance with the present invention, the second forming means 68 acts on the same gusset portion and lower side wall portion combination as the first forming means 42, namely gusset portion 40 and lower side wall portion 44. However, in the preparation of a different package, it may be desirable to perform a second operation on the other gusset portion and lower side wall portion combination. Moreover, the second forming means 68 operates during the rest periods between movements when the apparatus is an intermittent motion-type, and sequentially performs its forming operation on each subsequent pouch formed.

Figure 3:
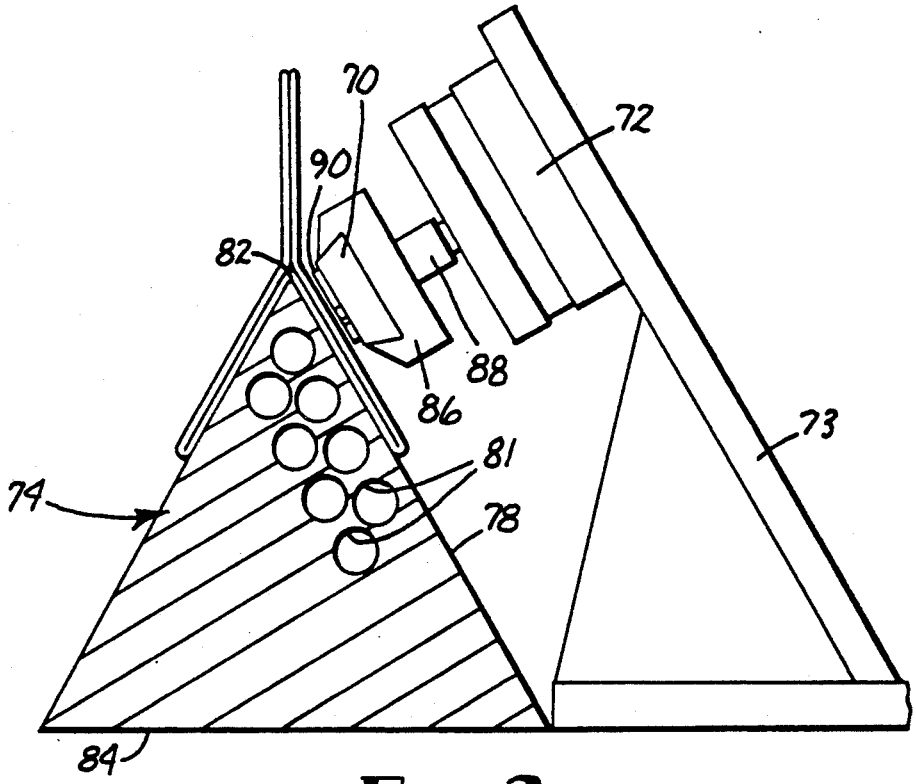
FIG. 3 is a transverse cross-sectional view taken along line 3—3 in FIG. 1 illustrated a second forming operation where a cutting forming operation is performed while a separation plow is extended within the gusset of the continuous flexible web material so as to urge legs thereof away from one another during the cutting operation.

In accordance with the present invention, the second forming means 68, as seen in FIG. 3, comprises a reciprocally moveable cutting die 70 which is used to cut away a portion of the gusset portion 40 and lower side wall portion 44 combination that has been previously partially sealed together. In other words, some of the partial heat sealed portion 67 is trimmed away for each pouch formed. Preferably, there is one cutting operation performed by the cutting die 70 for each partial heat sealed portion 67. The reciprocating cutting die 70 can be reciprocally driven by any conventional means and timed in accordance with the operation of the first forming means 42 and the advancing means, described below, as timed to the drive assembly for the subject apparatus. As shown in FIG. 3, and different from the conventional drive linkage for the first forming means 42, the cutting die 70 is preferably reciprocally driven by an air cylinder 72. However, other equivalent drive means are contemplated, including mechanical, electrical, hydraulic, and the like. The air cylinder 72 is fixed relative to an apparatus frame (not shown) of the subject apparatus and is shown held in position by a bracket assembly 73 fixed to the apparatus frame. In order to appropriately time the cutting operation by activating the air cylinder 72, a conventional sensor mechanism is utilized to sense movement and resting of the web material 10, such as by sensing rotation of a center drive shaft (not shown), and to actuate the air cylinder for cutting during the rest periods. In the present case, the provision of a microswitch (not shown) that is actuable by a cam of the center drive shaft (not shown) of the apparatus drive assembly is preferred. The microswitch is opened and closed by the cam so as to actuate the air cylinder 72 during each rest period.

In order to operatively separate both of the gusset portion and lower side wall portion combinations from one another during the cutting operation, a separation plow 74 is inserted within the gusset 28 of the web material 10 to urge each of the gusset portion and lower side wall portion combinations away from one another and away from their substantially vertical rest positions.

Figure 6:
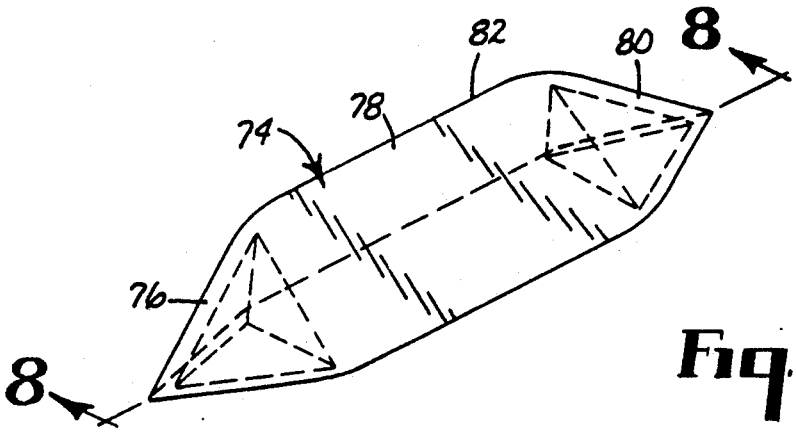
FIG. 6 is a perspective view of the separation plow which is inserted within the longitudinal gusset of the folded flexible web material which is inserted within the gusset to urge the legs of the flexible web material away from one another during the cutting operation.
Figure 8:
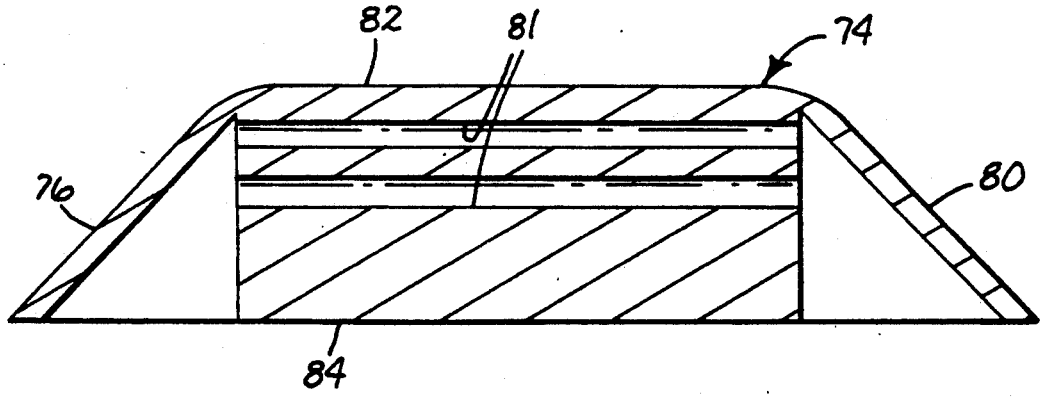
FIG. 8 is a longitudinal cross-sectional view of the separation plow taken along line 8—8 in FIG. 6.

Referring now to FIG. 6, the separation plow 74 is illustrated in perspective and is divided into a leading portion 76, an intermediate portion 78 and a trailing portion 80. The leading portion 76, intermediate portion 78 and trailing portion 80 may be integrally made or from separate components. The separation plow 74 may be hollow or solid, or a combination thereof. Preferably, as shown in FIGS. 3, 6 and 8, the leading portion 76 and trailing portion 80 are hollow and the intermediate portion 78 is solid. Moreover, it is contemplated that the intermediate portion 78 be provided with passages 81 through which fluid can be circulated for cooling or heating the intermediate portion 78. Cooling is preferably added if required to counter excess heat from the heat sealing operations depending on the material and- /or sealing temperature requirements. Fluids such as air, gases, or liquids can be conventionally utilized to cool or heat the intermediate portion 78 by appropriately connecting the passages 81 to manifolds, heat exchangers and pumps or compressors (not shown) as required. Preferably, according to the present invention, cooled air is circulated through the passages 81 to cool intermediate portion 78 and thus the folded flexible web material 10 during the cutting operation described above. To do this, the hollow leading and trailing portions 76 and 80 are utilized as manifolds to the passages 81, and the hollow interior of one of portions 76 and 80 is sealingly connected with a cooled air source (not shown).

Referring back to FIG. 1, as the folded flexible web material 10 leaves the first forming means 42, the bottom gusset 28 is split by the leading portion 76 of the separation plow 74 to urge the gusset portion and lower side wall portions away from one another. Once the folded flexible web material 10 advances to the intermediate portion 78, the gusset portion and lower side wall portion combinations are maintained substantially uniformly apart over a length sufficient for the cutting operation to take place. In other words, the longitudinal length of the intermediate portion 78 between leading portion 76 and trailing portion 80, is such that the cutting die 70 operates within that longitudinal length. Note that it is not necessary that the trailing portion 80 be provided; however, it is preferred so as to provide a smoother transition for the flexible web material 10 from the intermediate portion 78 back to its non-separated state where the gusset portion and lower side wall portion combinations lie substantially vertically for further processing. The apex 82 of the separation plow 74 preferably extends substantially entirely within the bottom gusset 28 over the length of the intermediate portion 78. Moreover, the height of the plow 74, that is the distance from apex 82 to the bottom edge 84 of plow 74, can be chosen in accordance with the depth of the bottom gusset 28 and the length of each gusset portion and lower side wall portion combination.

The cutting die 70 is connected with the air cylinder 72 by way of a mounting block 86 which is operatively fixed with the piston 88 of the air cylinder 72. Piston 88 is moveable by the air cylinder 72 in a conventional manner. Preferably, the cutting die 70 and mounting block 86 are designed to have a dove-tail type connection therebetween for relatively fixing the cutting die 70 to the mounting block 86 in the direction of movement of piston 88. Of course, other connecting means for fixing the cutting die 70 to the mounting block 86 in the direction of movement can be used.

Figure 5:
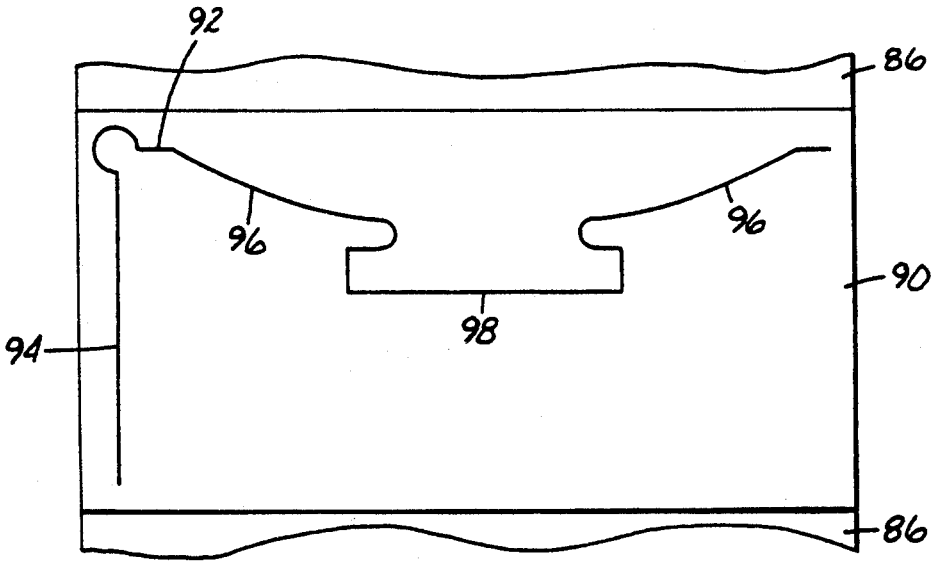
FIG. 5 is a front view of the cutting die shown in FIG. 3 illustrating one cutting configuration which removes some of the heat sealed material made during the spout formation so as to provide each individual spout with an easy-open feature.

Referring now to FIG. 5, which is a front view of the cutting die 70 looking from the folded flexible web material 10 in FIG. 3, the front face 90 of the cutting die 70 is provided with a raised knife edge 92. The knife edge 92 extends outward from the front face 90 and defines the shape of the cut-out which is to be taken from the folded flexible web material 10 during each operation of the cutting die 70. More specifically, the knife edge 92 cuts away a portion of the partial heat sealed portion 67 of the gusset portion 40 and lower side wall portion 44 combination that has been sealed by the first forming means 42. One such cutting operation preferably takes place for each heat sealed portion 67 sequentially along the folded web material 10 and during the rest periods between movements for an intermittent motion-type forming machine.

In one specific configuration for removing the material in a desired shape, the knife edge 92 shown in FIG. 5 includes a transverse cutting portion 94 which is located near the downstream edge of cutting die 70, as illustrated in FIG. 1, and which cuts the gusset portion 40 and lower side wall portion 44 combination from the fold line therebetween up to substantially the gusset fold line 36. The remainder of the knife edge 92 is divided into spout forming portions 96 which each lead to an easy opening tab forming portion 98. Thus, as the cutting die 70 is driven by the air cylinder 72 into the folded flexible web material 10 during each sequential cutting operation, some of the partial heat sealed portion 67 formed by the first forming means 42 is trimmed away leaving a spout with an easy opening tab 100, shown clearly in FIGS. 1 and 7. Moreover, the entire spout 66 is maintained sealed by a seam 102 which comprises the remainder of the partial heat sealed portion 67 that is left after the cutting operation is performed. Furthermore, the spout 66 further extends within the easy opening tab 100 so that by tearing or cutting the tab 100 at recesses 104 thereof, the spout 66 is opened to provide an easy opening feature for each individual pouch 12.

It is understood that instead of trimming individual pieces from each pouch converted in accordance with the present invention, the excess material comprising portions of each partial heat sealed portion 67 could be cut away as a strip. To do this, the knife edge 92 would have a somewhat different configuration. Specifically, the transverse cutting portion 94 of the knife edge 92 would not be provided on the cutting die 70, and the knife edge 92 would be slightly extended in the longitudinal direction of the flexible web material 10 to insure at least a slight overlap of the cutting edge in each successive cutting operation. As mentioned above, the knife edge 92 should cut through the gusset portion 40 and lower side wall portion 44 combination of the folded flexible web material 10 while acting against the intermediate portion 78 of the plow 74. Thus, the longitudinal length of the knife edge 92 that is used to cut the web material 10 should not exceed the longitudinal length of the intermediate portion 78 regardless of whether individual pieces or a strip of material are trimmed.

It is also understood that the cutting die 70 could be designed as a double spout cut which would have two complete spout shaped knife edges arranged continuously end-to-end which together have a longitudinal length of twice a single spout cut. Such a cutting die would only need to be activated once for every two forward indexes of the web material 10. In such case, the intermediate portion 78 would also be at least twice as long. In the same sense, three or more spout cuts could be done by a single cutting die which would be activated one time to trim a like number of pouches as there are spout cuts on the cutting die. This technique of performing plural forming operations of the same type by a single actuation of the forming means can also be utilized in any type forming operation, including the heat sealing operation described above by the first forming means 42.

Furthermore, it is not necessary that a trimming operation be performed at all. The spouts 66 may be simply formed, as above, by the first forming means 42 and the excess material can be left as part of the pouch. Moreover, such would be even more desirable if the spout design is such that there is only minimal excess material, of if an easy opening feature is not desired. The amount of excess material can be lessened by making the gusset portion 40 and lower side wall portion 44 combination shorter from fold line 36 than the other gusset portion 38 and lower side wall portion 46 combination. Such can be done by controlling the folding operation of the plow assembly 22.

Referring again to FIG. 1, after the cutting operation has been performed, individual spouts 66 sealed by seams 102 and having easy opening tabs 100 are fully formed. Next, a first side sealing means 106 performs a spot sealing, preferably heat sealing, operation midway between spouts 66 and at the point where the folded web of material 10 along its transverse direction changes from four layers to two layers. This is at the gusset fold line 36 between side walls 24 and 26. Spot seals 108 are provided which ensure a good seal at the vulnerable transition point from four layers to two layers. The spot sealing is not required, but may be preferable to ensure a good side seal. If not used, the side seal described below or equivalent provides the complete side seals.

Thereafter, a second side sealing means 110 is provided which performs a complete side sealing operation from the bottom transverse edge of the folded web material 10 to the top transverse edge. Each second side sealing operation occurs between successive spouts 66 and preferably includes the area of the spot seal 108. The second side sealing means 110 comprises a pair of sealing bars 112, preferably heat sealing bars, which are reciprocally moveable relative to one another and to the folded flexible web material 10 by conventional means connected and timed with the machine drive assembly so as to perform the side sealing operation and to form side seals 114 during each rest period between movements of an intermittent motion type machine. Preferably, the sealing bars 112 form structured or ribbed side seals 114. At this point, a plurality of individual pouches 12 have been formed which are connected in series with one another. Of course, it is not critical that this side sealing operation take place at the specific sequential location described above and illustrated in the Figures. Such could be done at any time after the initial folding operation before or in between the other forming operations.

An advancement means 116 is also provided for selectively advancing the folded flexible web material 10 in accordance with the processing steps of the present invention. Specifically, the advancement means 116, in accordance with the preferred embodiment of the present invention, advances the folded flexible web material 10 forwardly incrementally by an amount sufficient to define each individual pouch 12. The amount of each advancement corresponding to each pouch formed is hereinafter referred to as an index. However, if each forming means performs a like number of plural operations, the amount of the advance should correspond to that number of operations. Preferably, the advancement means 116 comprises drive rollers 118 which contact with the folded flexible web material 10 so that a single index of the flexible web material 10 occurs as a result of a measured rotation of the drive rollers 118. The drive rollers 118 are conventionally connected with the main drive assembly of the apparatus of the present invention and are controlled in a well known manner to provide such incremental and intermittent indexing of the flexible web material 10. It is contemplated that many other advancement techniques can be utilized instead. For example, draw bars which grab and pull the flexible web material could be easily used.

Up until now, the pouch forming process and apparatus of the present invention has been described; however, it is also an aspect of the present invention to fill each individual pouch 12 with product and to finally seal each individual pouch 12 and to separate the individual pouches 12 from one another. To do these, a filling station 120 is preferably provided in line with the aforementioned pouch forming apparatus. Of course, individual pouches 12 can be the final product or they could be otherwise filled at other locations. The filling station 120 may comprise any known dispensing device for filling the individual pouches 12 with a predetermined amount of product. Moreover, the filling station 120 is preferably related to the type of product which is to be dispensed. Examples of products dispensed include flowable materials which may be of particulate form or liquid, or other products where one or more of such products are dropped within the interior cavity of each pouch 12. The present invention is particularly applicable to the provision of individual pouches 12 which are to contain foodstuffs, such as cheeses, sauces, syrups, and the like, which are to be microwave heated within the pouches 12 and which can be dispensed therefrom after heating. Other products could include cold foods, such as jellies, toppings, candies, etc., and non-food materials which may or may not require heating, such as adhesives, plasters, powders, etc.

After a predetermined quantity of product is dispensed within each individual pouch 12, each pouch 12 is sealed at a top end thereof by a top end sealing means 122. The top end sealing means 122 comprises similar sealing bars 124 as the side sealing bars 112 which are preferably heat seal bars which are conventionally reciprocally driven to one another and to the pouches 12 to form end seals 126 during the rest period between movements of an intermittent motion machine in accordance with the present invention.

Once the end seals 126 are provided, each pouch 12 including product is completed, and a cutting means 128 is provided to sever the pouches 12 from one another. The cutting means 128 comprises a reciprocating blade 130 and a stationary blade 132. The reciprocating blade 130 is conventionally driven from the main drive assembly of the apparatus of the present invention so as to perform each cutting operation for splitting the side seals 114 to divide each individual pouch 12 from one another.

Whether or not the pouches 12 are filled in line, it is not necessary to cut the pouches 12 from one another. The pouches 12 could be packaged while connected together, such as by a fan folding technique, for separation at a remote location. To further facilitate this type of use, a line of weakening could be provided by an operation in place of the cutting means 128. Such operation could be used to make a line of weakening, such as by perforations or the like, so that the pouches 12 could be easily separated from one another at the remote location. To make such a line of weakening, the reciprocating blade 130 can be a perforation blade or may be controlled otherwise to only cut part way through the material, or the like.

Figure 7:
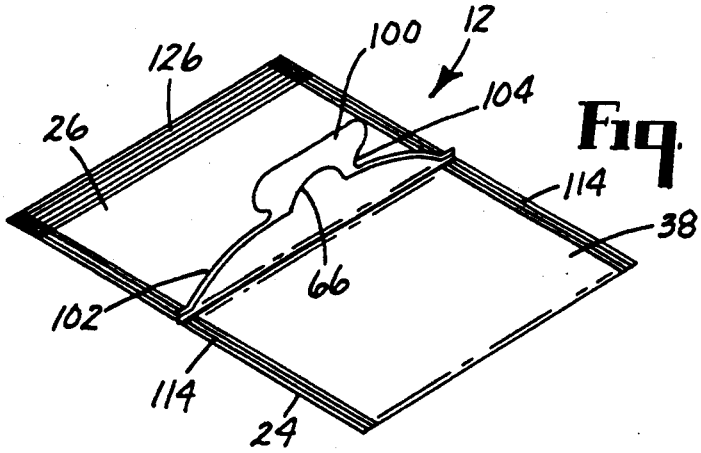
FIG. 7 is a perspective view of a single filled pouch formed in accordance with the present invention.

As a result, individual product containing pouches 12 are formed, as shown in FIG. 7, which provide a substantially lay-flat type bag. Such a lay-flat bag is particularly applicable to heating of product within the pouch 12 in a microwave oven. In this regard, similar product containing pouches are the subject matter of copending United States patent application Ser. No. 07/415,999, filed Oct. 2, 1989, which is commonly owned by the assignee of the present invention, and which the subject matter thereof is fully incorporated herein by reference. However, by the process and apparatus of the present invention, unique product pouches 12 are formed. Such pouches are included within the subject matter of copending U.S. patent application Ser. No. 07/804,802 filed Dec. 9, 1991, which is commonly owned by the assignees of the present application.

Specifically, the product pouches 12 of the present invention comprise a spout 66 with easy opening tab 100 and seam 102 formed from one of the gusset portion and lower side wall portion combinations, described above. Moreover, the spout 66 is substantially centrally located along a top surface of the substantially lay-flat bag comprising pouch 12. The bottom surface of the lay-flat bag comprises the side wall 24 including the lower side wall portion 46 thereof, and the upper surface comprises only the upper portion of side wall 26 and gusset portion 38. Furthermore, the sides of the pouch 12 are defined by portions of side seals 114, and one end of each pouch 12 is sealed by an end seal 126. Such end seal 126 in combination with the side seals 114 is specifically characteristic of a pouch formed in accordance with the subject inventive process and apparatus.

The flexible web material 10 can comprise any known flexible material used in the making of product packages, such as films, laminates, nonwovens, wovens, etc. With regard to the packaging of foodstuffs, such material should be acceptable for such use. It is also preferable that the material be heat sealable to itself so that the sealing operations performed at the first forming means 42, first side sealing means 106, second side sealing means 110 and top end sealing means 122 can be preferably performed by heat sealing techniques. If heat sealing is not utilized, other sealing techniques, such as the use of adhesives, for example, pressure-sensitive or pressure activated adhesives could be substituted.

The flexible web material 10 may comprise a microwave transparent material such as that described in copending United States patent application Ser. No. 07/619,240, filed Nov. 28, 1990, commonly owned by the assignee of the present invention, and fully incorporated herein by reference. Briefly, such material comprises a multiple layer material including a heat sealable layer and an insulating layer. Additional layers may be included for oxygen and/or moisture impermeability, and the insulating means is preferably a polymeric foam. It is, however, understood that the process and apparatus of the present invention is applicable to the formation of pouches 12 of other materials depending on the end use of the formed pouches. For instance, if the pouch is to be used to dispense material at room temperatures, the insulating layer may not be preferred. In the case of a cold material, such insulation may or may not be desired.

In one example of a microwavable pouch 12 according to the present invention, the flexible web material 10 was constructed by laminating the polyvinylidene chloride (PVDC) side of a 0.00052 inch (0.013 mm) thick support layer of Scotchpar TM 2708 brand film available from Minnesota Mining and Manufacturing Company of St. Paul, Minn. to a 0.001 inch (0.025 mm) thick heat sealing layer of CP136 polypropylene film available from the Crown Advanced Film Division of James River Corporation of Orange, Tex. with Adcot 76T198 adhesive available from Morton Thiokol of Chicago, Ill. (dry weight of two-three pounds per three thousand square feet of film). An insulating layer of 0.0625 inch (1.59 mm) thick polypropylene foam available from Ametek, Inc. of Chadds Ford, Pa. under the trademark "MICROFOAM" was laminated with a Swift Number 48803 brand pressure sensitive adhesive available from the Swift Adhesives Division of Reichhold Chemicals, Inc. of Downer's Grove, Ill. to the outside of the film. A 0.00057 inch (0.014 mm) thick layer of Scotchpar TM 86096 brand film may be substituted for the Scotchpar TM 2708 brand film.

Another suitable flexible web material for food pouches comprises 0.002 inch (0.051 mm) of cast propylene adhesive laminated onto 0.00048 inch (0.012 mm) polyester. This combination is then adhesive laminated to a 0.01 inch (0.254 mm) foam sheet made from resin consisting of a 50/50 blend of polystyrene and polyphenlyene oxide, such as the resin available from General Electric under the trademark "Noryl" TM. The 0.00048 (0.012 mm) polyester may be replaced with a polyvinylidene chloride coated polyester approximately 0.00052 inch (0.013 mm) in thickness if increased oxygen and moisture properties are desired in the final structure.

The process and apparatus of the present invention, described above, is particularly applicable to intermittent motion type horizontal package forming machines. By horizontal, it is meant that the pouches are formed in a direction generally perpendicular to the direction from which product is fed into the individual pouches. The process could be easily adapted for such a horizontal machine having a continuous movement by substituting for the heat sealing elements and the cutting dies with continuous type heating elements and cutting dies. Typically, for a continuous motion machine, the heating bars and cutting dies are rotationally driven in accordance with the timing of the machine and with respect to one another.

Moreover, in a preferred form of the apparatus of the present invention, a horizontal intermittent motion packaging machine known under the trademark "BARTELT TM" is particularly adaptable to the subject process and apparatus. Such a packaging machine generally consists of a base assembly which contains a variable speed drive unit, a central drive shaft, cam mechanisms, and a conveyor drive. The mechanisms for performing the forming operations and filling and sealing the bags are mounted on the top of the base assembly. Such mechanisms may include web handling, bag forming, bag cut off and clamping, bag opening devices, bag filling devices, top sealing mechanisms, and bag pick off mechanisms. Moreover, all functions of the machine are operated or timed from the central drive shaft which makes one complete revolution for each bag produced. During part of the revolution or cycle, the flexible web material and formed pouches are indexed forward one station then stopped for performing individual forming operations or sealing and filling the pouches. Typically, the flexible web material is continuously supplied and folded with or without a gusset, and bottom and side seals are made. Thereafter, the formed pouches are cut into individual pouches and are picked up by clamping mechanisms connected with a conveyor. Thereafter, the individual pouches are filled with product, and lastly, a top seal closing off the pouch is performed. Thus, with reference to the process and apparatus described above and illustrated in FIG. 1, the pouches 12 could be cut apart from one another before the filling station 120 and the individual pouches could be conveyed through a conveyor system which conveys the individual pouches through a filling station and a top sealing station.

Many other types of forming operations could also be used depending on the desired product pouch, and additional other steps could be done on the specifically described pouches 12 described above. For instance, an additional fold line or lines could be provided to the pouches 12 to improve dispensing of product therefrom. Referring to FIG. 1, a fold line, such as a score line, could be formed in the side wall 24 of the folded web material 10 in line with the gusset fold line 36. Such could be easily facilitated between the folding step and the first forming means 42. Moreover, to improve filling of the pouches 12, the spouts 66 could be clamped or collapsed during the filling operation. One manner of doing so would be to plow the spouts 66 upwardly during filling so that product dispensed in the pouches would not fill the spouts 66. An optional heat seal at the bottom of each pouch could also easily be provided to balance the overall pouch design.

It is also understood that many other modifications could be made to the process and apparatus described above within the spirit of the present invention. Specifically, many other forming operations could be selectively performed on one or the other of the gusset portion and lower side wall portion combinations. For example, one or more forming operations can be performed on one of the gusset portion and lower side wall combinations, while other distinct forming operations can be performed on the other gusset portion and lower sidewall portion combination. Moreover, the same operations could be performed on both gusset portion and lower side wall combinations at different times. Clearly, by the present invention, many pouch configurations can be envisioned including the use of forming operations such as printing, labelling, sealing operations and/or cutting operations, and the like, for selectively modifying one of or both of the gusset portion lower sidewall portion combinations independently from one another.

Preferably, as above, the gusset portion and lower sidewall portion combinations are separated from one another during such forming operations by some type of separating element which extends within the formed gusset of the folded web material. In this regard, the separating plate 48, described above in first forming means 42, and the separating plow 74, described above in second forming means 68, are interchangeable. In this sense, by choosing the depth of the formed gusset, many other pouch configurations are possible. Clearly, the versatility of the process and apparatus of the present invention can lead to the production of enumerable pouch configurations and features thereof specifically related to the type of product to be packaged in such pouches. Moreover, since the process of the subject invention is applicable to known packaging machines, such complex pouches can be formed at the speeds obtainable by present day machines.

Thus, the scope of the present invention should not be limited by the steps and operations described above according to the preferred embodiment of the present application, but only by the language of the appended claims.

What is claimed is:

1. A process for forming a pouch from flexible web material comprising the steps of:

(a) supplying flexible web material;

(b) folding the flexible web material into a generally W shape in cross-section defined by two side walls and a bottom gusset, the bottom gusset divided by a fold line into gusset portions which lie adjacent to lower side wall portions of the side walls;

(c) performing a forming operation by relatively modifying the relationship between the gusset portion and lower side wall portion of one of the gusset portion and lower side wall portion combinations of the folded flexible web material without performing said forming operation on the other gusset portion and lower side wall portion combination at the same time; and (d) forming a plurality of transverse seals dividing the folded flexible web material into at least one pouch.

2. The process of claim 1, further including the step of separating the one gusset portion and lower side wall portion combination from the other prior to performing said forming operation.

3. The process of claim 2, wherein said separating step comprises inserting a separation element within the gusset which extends toward the fold line of the gusset.

4. The process of claim 3, wherein said separation step further comprises plowing the one gusset portion and lower side wall portion combination away from the other by inserting a plow within the gusset.

5. The process of claim 4, wherein said plowing step is performed by relatively moving both of the gusset portion and lower side wall portion combinations from their folded positions.

6. The process of claim 3, wherein said forming operation comprises at least partially sealing the gusset portion to the lower side wall portion of the one gusset portion and lower side wall portion combination while the gusset portion and lower side wall portion combinations are separated from one another by the separation element.

7. The process of claim 6, wherein said forming operation comprises forming a dispensing spout from the one gusset portion and lower side wall portion combination by sealing the gusset portion to the lower side wall portion of the one gusset portion and lower side wall portion combination in the shape of a spout.

8. The process of claim 1, wherein said forming operation comprises sealing at least a part of the gusset portion to a part of the lower side wall portion of the one gusset portion and lower side wall portion combination, and removing some of the one gusset portion and lower side wall portion combination that has been sealed together.

9. The process of claim 8, wherein said sealing takes place during a first separation stage where the gusset portion and lower side wall portion combinations are separated from one another by inserting a separation element within the gusset, and said removing of some of the sealed gusset portion and lower side wall portion combination takes place during a second separation stage which comprises plowing the one gusset portion and lower side wall portion combination away from the other by inserting a plow within the gusset.

10. The process of claim 1, wherein said forming operation comprises at least partially sealing the gusset portion to the lower side wall portion of the one gusset portion and lower side wall portion combination.

11. The process of claim 1, wherein said forming operation comprises forming a dispensing spout from the one gusset portion and lower side wall portion combination.

12. The process of claim 11, wherein said forming operation further comprises sealing the gusset portion to the lower side wall portion of the one gusset portion and lower side wall portion combination in the shape of a spout.

13. The process of claim 1, wherein said folding step further comprises folding the flexible web material into a generally W shape cross section with the gusset portions of the gusset having unequal transverse lengths.

14. The process of claim 13, wherein the one gusset portion and lower side wall portion combination is folded to have a shorter transverse length than that of the other gusset portion and lower side wall portion combination.

15. In combination with the process for forming a pouch in claim 1, the additional steps of filling the at least one pouch with a product through an opening located opposed to the bottom gusset and in-between the transverse seals of the formed pouch, and sealing the opening of the pouch after said filling step.

16. The process of claim 15, further including the step of severing the filled pouches from one another after the filling and sealing thereof.

17. The process of claim 1, wherein the process is performed in-line.

18. The process of claim 17, wherein the process comprises an intermittent in-line process.

19. A form-fill-seal process for making a plurality of sealed product containing pouches from a sheet of flexible web material, said form-fill-seal process comprising the steps of:

(a) supplying flexible web material;

(b) folding the flexible web material so as to define, in cross-section, two side walls, a bottom gusset and a top opening, the bottom gusset divided by a fold line into gusset portions which lie adjacent to lower side wall portions of the side walls;

(c) performing a forming operation by relatively modifying the relationship between the gusset portion and the lower side wall portion of one of the gusset portion and lower side wall portion combinations of the folded flexible web material without performing said forming operation on the other gusset portion and lower side wall portion combination at the same time;

(d) forming a plurality of transverse seals dividing the folded flexible web material into a plurality of pouches, each pouch having a top opening;

(e) filling a plurality of the pouches with product through the top openings; and (f) forming a seal for closing the top openings of the filled pouches.

20. The form-fill-seal process of claim 19, further including the step of severing the filled pouches from one another after the filling and sealing thereof.

21. The form-fill-seal process of claim 20, wherein the process is performed in-line.

22. The form-fill-seal process of claim 21, wherein the process comprises an intermittent in-line process.

23. An apparatus for forming a plurality of pouches from flexible web material comprising:

(a) means for continuously supplying flexible web material;

(b) means for longitudinally advancing the flexible web material;

(c) means for longitudinally folding the flexible web material during advancement thereof into, in transverse cross-section, two side walls, a bottom gusset and a top opening, the bottom gusset divided by a fold line into gusset portions which lie adjacent to lower side wall portions of the side walls;

(d) means for performing a forming operation that relatively modifies the relationship between the gusset portion and lower side wall portion on one of the gusset portion and lower side wall portion combinations of the folded flexible web material without performing said forming operation on the other gusset portion and lower side portion combination at the same time; and (e) means for forming spaced transverse seals along the folded flexible web material so as to divide the folded flexible web material into at least one pouch having a top opening.

24. The apparatus of claim 23, further including a means for at least partially separating the one gusset portion and lower side wall portion combination from the other during the forming operation.

25. The apparatus of claim 24, wherein said separating means comprises an element which extends within the bottom gusset.

26. The apparatus of claim 25, wherein said element comprises a plow which urges the gusset portion and lower side wall portion combinations away from one another.

27. The apparatus of claim 26, wherein said plow includes a leading portion having a surface which contacts one gusset portion of the bottom gusset to urge the one gusset portion and lower side wall portion combination away from the other.

28. The apparatus of claim 26, wherein said plow includes a leading portion having two surfaces divided from one another, and one surface contacts with one of the gusset portions of the bottom gusset while the other surface contacts the other gusset portion to urge both of the gusset portion and lower side wall portion combinations away from their folded positions.

29. The apparatus of claim 24, wherein said means for performing a forming operation comprises a sealing means for sealing at least a part of the gusset portion to a part of the lower side portion of the one gusset portion and lower side wall portion combination while the gusset portion and lower side wall portion combinations are separated from one another by the separation element.

30. The apparatus of claim 29, wherein said sealing means includes a heated sealing surface which defines the shape of a spout that is formed from the one gusset portion and lower side wall portion combination by heat sealing the gusset portion to the lower side wall portion of the one gusset portion and lower side wall portion combination in the shape of a spout.

31. The apparatus of claim 23, wherein said means for performing a forming operation comprises a sealing means for at least partially sealing the gusset portion to the lower side wall portion of the one gusset portion and lower side wall portion combination, and a cutting means for removing some of the one gusset portion and lower side wall portion combination that has been sealed together.

32. The apparatus of claim 31, further including a separating means for separating the gusset portion and lower side wall portion combinations, said separating means comprising a first separating stage wherein a separation element is inserted within the gusset at said sealing means, and a second separating stage wherein a plow is inserted within the gusset at said cutting means.

33. The apparatus of claim 32, wherein said cutting means comprises a reciprocating cutting die, and said plow provides a die backing surface against which said cutting die acts.

34. The apparatus of claim 23, wherein said means for performing a forming operation comprises a sealing means for at least partially sealing the gusset portion to the lower side wall portion of the one gusset portion and lower side wall portion combination.

35. The apparatus of claim 23, wherein said means for performing a forming operation comprises a means for forming a dispensing spout from the one gusset portion and lower side wall portion combination.

36. The apparatus of claim 35, wherein said means for forming a dispensing spout comprises a reciprocating sealing element including a heated sealing surface having the shape of a spout which, when contacted with the lower side wall portion of the one gusset portion and lower side wall portion combination, heat seals the one gusset portion to the lower side wall portion in the shape of a spout.

37. The apparatus of claim 23, further including a means for filling the at least one pouch with product after the pouch is formed with a top opening by the means for forming spaced transverse seals.

38. The apparatus of claim 37, further including a means for providing a top seal to close the top opening after the at least one pouch is filled with product.

39. The apparatus of claim 38, further including a means for severing the filled and sealed pouch from the folded flexible web material.

40. The apparatus of claim 23, wherein said means for longitudinally advancing the flexible web material comprises an intermittent drive mechanism.

41. A process for forming a pouch from flexible web material comprising the steps of:

(a) supplying flexible web material;

(b) folding the flexible web material into a generally W shape in cross-section defined by two side walls and a bottom gusset, the bottom gusset divided by a fold line into gusset portions which lie adjacent to lower side wall portions of the side walls;

(c) performing a forming operation on one of the gusset portion and lower side wall portion combinations of the folded flexible web material without performing said forming operation on the other gusset portion and lower side wall portion combination at the same time, wherein said forming operation comprises forming a dispensing spout from the one gusset portion and lower side wall portion combination; and (d) forming a plurality of transverse seals dividing the folded flexible web material into at least one pouch.

42. A process for forming a pouch from flexible web material comprising the steps of:

(a) supplying flexible web material;

(b) folding the flexible web material into a generally W shape in cross-section defined by two side walls and a bottom gusset, the bottom gusset divided by a fold line into gusset portions which lie adjacent to lower side wall portions of the side walls, wherein said folding step further comprises folding the flexible web material into a generally W shape cross-section with the gusset portions of the gusset having unequal transverse lengths;

(c) performing a forming operation on one of the gusset portion and lower side wall portion combinations of the folded flexible web material without performing said forming operation on the other gusset portion and lower side wall portion combination at the same time; and (d) forming a plurality of transverse seals dividing the folded flexible web material into at least one pouch.

43. An apparatus for forming a plurality of pouches from flexible web material comprising:

(a) means for continuously supplying flexible web material;

(b) means for longitudinally advancing the flexible web material;

(c) means for longitudinally folding the flexible web material during advancement thereof into, in transverse cross-section, two side walls, a bottom gusset and a top opening, the bottom gusset divided by a fold line into gusset portions which lie adjacent to lower side wall portions of the side walls;

(d) means for performing a forming operation on one of the gusset portion and lower side wall portion combinations of the folded flexible web material without performing said forming operation on the other gusset portion and lower side portion combination at the same time, wherein said means for performing a forming operation comprises a means for forming a dispensing spout from the one gusset portion and lower side wall portion combination; and (e) means for forming spaced transverse seals along the folded flexible web material so as to divide the folded flexible web material into at least one pouch having a top opening.

44. An apparatus for forming a plurality of pouches from flexible web material comprising:

(a) means for continuously supplying flexible web material;

(b) means for longitudinally advancing the flexible web material;

(c) means for longitudinally folding the flexible web material during advancement thereof into, in transverse cross-section, two side walls, a bottom gusset and a top opening, the bottom gusset divided by a fold line into gusset portions which lie adjacent to lower side wall portions of the side walls;

(d) means for performing a forming operation on one of the gusset portion and lower side wall portion combinations of the folded flexible web material without performing said forming operation on the other gusset portion and lower side portion combination at the same time;

(e) means for forming spaced transverse seals along the folded flexible web material so as to divide the folded flexible web material into at least one pouch having a top opening; and (f) means for filling the at least one pouch with product after the pouch is formed with a top opening by the means for forming spaced transverse seals.

* * * * *